United States Patent [19]

Taylor

[11] 3,982,688

[45] Sept. 28, 1976

[54] EARTH-MOVING APPARATUS

[76] Inventor: Charles G. Taylor, 4252 Fair Ave., Apt. 15, North Hollywood, Calif. 91602

[22] Filed: Nov. 25, 1974

[21] Appl. No.: 526,525

[52] U.S. Cl. ..... 299/64; 37/85; 37/192 R; 299/82

[51] Int. Cl.[2] ..... E21L 27/20

[58] Field of Search ..... 299/18, 64, 56, 58, 299/67, 68; 37/85, 192; 37/190, 191 R, 191 A

[56] References Cited

UNITED STATES PATENTS

| | | | |
|---|---|---|---|
| 766,584 | 8/1904 | Battey | 37/85 |
| 1,289,108 | 12/1918 | Bunnell | 37/85 |
| 1,472,562 | 10/1923 | Knight | 37/192 R |
| 1,478,466 | 12/1923 | Anderson | 299/56 |
| 3,658,385 | 4/1972 | Oven | 299/67 X |
| 3,757,491 | 9/1973 | Gourdine | 299/12 |

FOREIGN PATENTS OR APPLICATIONS

| | | | |
|---|---|---|---|
| 1,073,592 | 1/1953 | France | 37/85 |
| 170,866 | 4/1965 | U.S.S.R. | 299/67 |

*Primary Examiner*—Ernest R. Purser
*Assistant Examiner*—William F. Pate, III
*Attorney, Agent, or Firm*—Wm. Jacquet Gribble

[57] ABSTRACT

A self-propelled machine for cutting and moving earth as from a mine face in a shaft or earth from a bank or other natural terrain and having a prime mover vehicle for advancing pairs of conveyor chain sprockets that support and power chain-mounted cutters and scoops. Preferably a separate power source other than the mover vehicle drives the conveyor chain sprockets. Belt conveyors receive earth from the scoops and discharge it away from the machine. The conveyor chains not only are powered separately from the vehicle but travel in a path across the advance of the vehicle. Cutter blades on the forward chain each have a plurality of replaceable teeth on the blade outboard of the foremost chain of the pair. The vehicle or prime mover may be a crawler tractor or other powered apparatus to which the earth-moving apparatus is attached for spatial adjustment with respect to the work.

9 Claims, 6 Drawing Figures

5
10
12
13
14
15
41
45
48
51
52
57
72
73
74
76
77
78
79
81
82
85
86
87
88
89
91
94
95
111
112
113
114
117
118
125
127
129
129'
133

EARTH-MOVING APPARATUS

BACKGROUND OF THE INVENTION

The invention relates to earth-moving machinery and particularly to such machinery that digs out and displaces earth.

Earth-moving machinery replaces manpower. Its efficiency depends on how many men or other machines it can replace. One basic measure of efficiency is cubic yards of material per operator. Other measures relate to cubic yards displaced per hour and cubic yards displaced per horsepower. The first and the second measures are most important. Natural soil and mineral veins vary in density, hardness and moisture content, and therefore in weight per cubic yard and in cutting resistance. All of these factors affect the rate of material removal. I have invented apparatus for a large range of material handling which is not only versatile in scope of materials handled, but is adaptable to many work situations, and is easily repaired and moved along its own work path. The invention has as its objectives accomplishment of all or some of the functions of the bulldozer, either wheeled or crawler type, ripper, the back hoe, the trencher-ditcher, a bucket loader and drag line, as well as tunneling and boring machines, coal seam digging machines and scrapers of the pull type or self-propelled or push type. For short distances, the apparatus of the invention has as an objective the replacement of the conventional short haul vehicles.

SUMMARY OF THE INVENTION

The invention contemplates apparatus which comprises a pair of parallel digger conveyors supported on spaced, paired wheels which are in turn supported by a self-propelled prime mover. The conveyors are powered from a source separate from the prime mover and progress in planes transverse to the path of advance of the prime mover. Scoop buckets fixed at each of their ends to one of the chains extend between the chains. Radial cutting arms at each scoop bucket removably mount cutter blades which extend outwardly from the chains commensurate with the like extent of the scoop buckets. The arms also extend inwardly into the space defined by the run of the front conveyor chain across the path of the prime mover.

Preferably a frame supports the digger conveyors from the prime mover and hydraulic means controllable by the operator of the prime mover afford vertical adjustment of the conveyor chains with respect to the work. In a preferred embodiment endless conveyor belts receive cuttings from the scoop buckets and carry them to a discharge point beyond the locus of operation of the earthmoving apparatus. Additional apparatus may provide for water spraying the cuttings as they leave the scoop buckets both for easy compaction upon discharge from the conveyor belt system and to reduce the dust resulting from the cutting and handling of the earth moved.

The prime mover mentioned above may be either a crawler or wheeled tractor rig or may be a crane and boom, depending upon the particular useage of the apparatus. Such useages are exemplified by the fields of strip mining, tunnel mining, earth moving and road building.

While two pairs of spaced conveyor sprockets or wheels have been alluded to above, the path of the conveyors and therefore the configuration of the area dug by the apparatus may be changed. For instance, three pairs of conveyor sprockets may be triangularly arranged to achieve a tunnel shaft with a flat floor and a sloping roof. Conversely, by reversing the position of the transversely central sprocket pair, a floor may be achieved sloping downwardly from both sides.

The apparatus of the invention may be powered from presently available power units and either be attached to or fabricated upon the frames of present prime movers, either crawled or wheeled, or rail bound. In addition to performing many of the functions of specialized equipment, the apparatus of the invention in many instances eliminates the need for hazardous blasting and expensive auxiliary drilling equipment. Its operation is adaptable to both static guide line and laser beam path guidance equipment and is completely responsive to the commands of a single operator using conventional control systems.

These and other advantages of the invention are apparent from the following detailed description and drawing.

DESCRIPTION OF THE PREFERRED EMBODIMENTS

Figure 1:
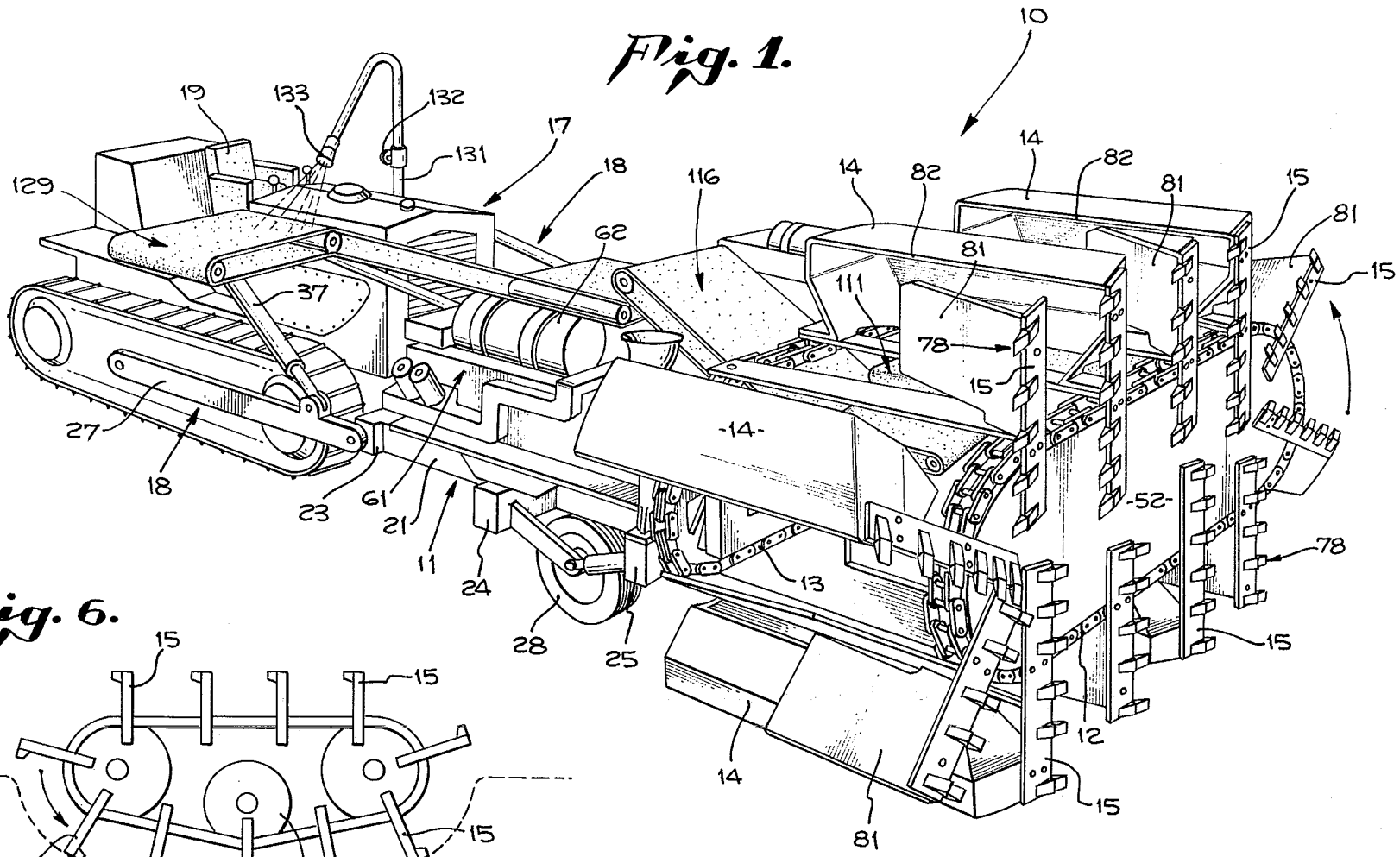
FIG. 1 is a perspective elevation of an embodiment of the invention combined with a crawler tractor as a prime mover.

In FIGS. 1–4 earthmoving apparatus indicated generally at 10 comprises a frame 11 supporting front and rear chain conveyors 12, 13, to which a plurality of scoop buckets 14 and cutter arms 15 are secured. The frame 11 is in turn supported from a crawler tractor prime mover 17 by hydraulically actuated linkage shown generally at 18. The hydraulic linkage is under the control of an operator who normally occupies the cockpit 19 schematically represented in FIG. 1.

The tractor may be of the type manufactured and marketed by Caterpillar under the model designation D-9, with a power unit approximating 400 horsepower. Other comparable prime movers may be utilized, including tandem units, without departing from the spirit of the invention.

The Frame

While the invention contemplates excavators or earth movers which may be self-powered or attached to prime movers, the latter mode has been illustrated herein. The frame described, therefore, is exemplary only, and not to be construed as limiting the invention only to attached excavators. As an attachment the frame comprises longitudinal sub-beams 21, 22 (FIGS. 2 and 3) with transverse beams 24, 25 forming a lower box 26. The box is coupled to the tractor by conventional hydraulically actuated position arms 27 on either side of the tractor. Auxiliary support wheels 28 may be employed depending on loads expected and terrain conditions. The inherent mass of the prime mover will in most cases be sufficient that the box and its load may be cantilevered from the prime mover.

Posts 31 rise at spaced points near the center of transverse beam 25, terminating upwardly in clevis ends 33 which receive fitting ends of hydraulic position cylinders 34, 35 anchored at their other ends to conventional points on the tractor. Coordinated control of the cylinders 34, 35 and the cylinders 37, 38 fastened to the sub-beams 21, 22, enables the excavator operator to vertically position the conveyor frame for proper operation with respect to the work surfaces, such as vertical cut face 39 of FIG. 3 and floor line 41 of the same Figure.

A digging conveyor structure cantilevers from box 26. The structure comprises central longitudinal girders 43, 44 fixed at one end to box beam 25, as by welding. The girders extend away from the tractor to be fixed to a transverse stringer 45, which is paralleled inboard by a segmented stringer 46, 46A, 46B. Posts 47, 48 on each stringer rise to support bearings (not shown) in which drive axles 49, 51 are mounted. The posts and stringers also support a dirt shield 52 mounted vertically within the travel circuit of the front digger conveyor chain 12.

The frame may be braced and augmented in ways and by parts commensurate with good engineering practices, but such conventional arrangement forms no part of this invention and is not further described.

The Digger Conveyor

The posts 47, 48 of the conveyor structure journal the axles 49, 51 to which the digger conveyor wheels or sprockets are fixed to rotate normally in a vertical plane. The posts of stringer 45 support sprockets 54, 55 upon which digger conveyor chain 12 runs. The posts of stringer 46 support sprockets 56, 57 of chain 13.

The sprocket wheels may be about six feet in diameter, with the chain size being commensurate. Separate power units 61, 62 schematically shown on lower box 26 are preferably coupled through separate but coordinated transmissions 63, 64 to axles 49 and 51, respectively. In the size illustrated the power units are chosen to impart power to the digger conveyor and the cuttings removal belt system 67 to achieve earthmoving rates in the vicinity of 2000 cubic yards per hour, and are therefore preferably capable of an output of about 600 horsepower per unit. Coordination of power output may be achieved by conventional control linkage between the power units or the transmissions operating in response to sensing instruments (not shown) reading the sprocket speed in RPMs.

A plurality of scoop buckets 14 are fixed to the digger conveyor chains 12, 13 at spaced intervals along the run of the chains. Each bucket has two sloping sides 71, 72 and a working panel 73 connecting to a load wall 74 to define the bucket volume. A connector panel 76 forms an incomplete side of a bucket and is fastened to the chain, so that cut dirt or minerals not only spill from the buckets when inverted by the travel of the chains but fall through the interval 77 of each bucket between the connector panel and the load wall 74.

A cutter arm 15 is fixed to the chain 12 and the bucket 14, extending from the chain radially as does each bucket, but also extending inwardly toward the wheel or sprocket axles. Between each pair of adjacent buckets is an intervening connector panel 76A, and a cutter arm is fixed to the panel and the chain 12 intermediate each bucket pair, such that there are twice as many cutter arms 15 as there are scoop buckets. The cutter arms all bear cutter blades 78 removably fixed to extend their cutting edges 79 in the direction of chain travel. A baffle 81 on each intermediate cutter arm 15 extends part way of the space between chains 12 and 13, directing cut material toward the center of the following scoop bucket. Thus the scoop buckets tend to be filled along their entire extent, not only from the cutting action of the edge 82 of each work panel 73, but also from the cuttings of each baffled cutter arm.

Figures 4, 5:
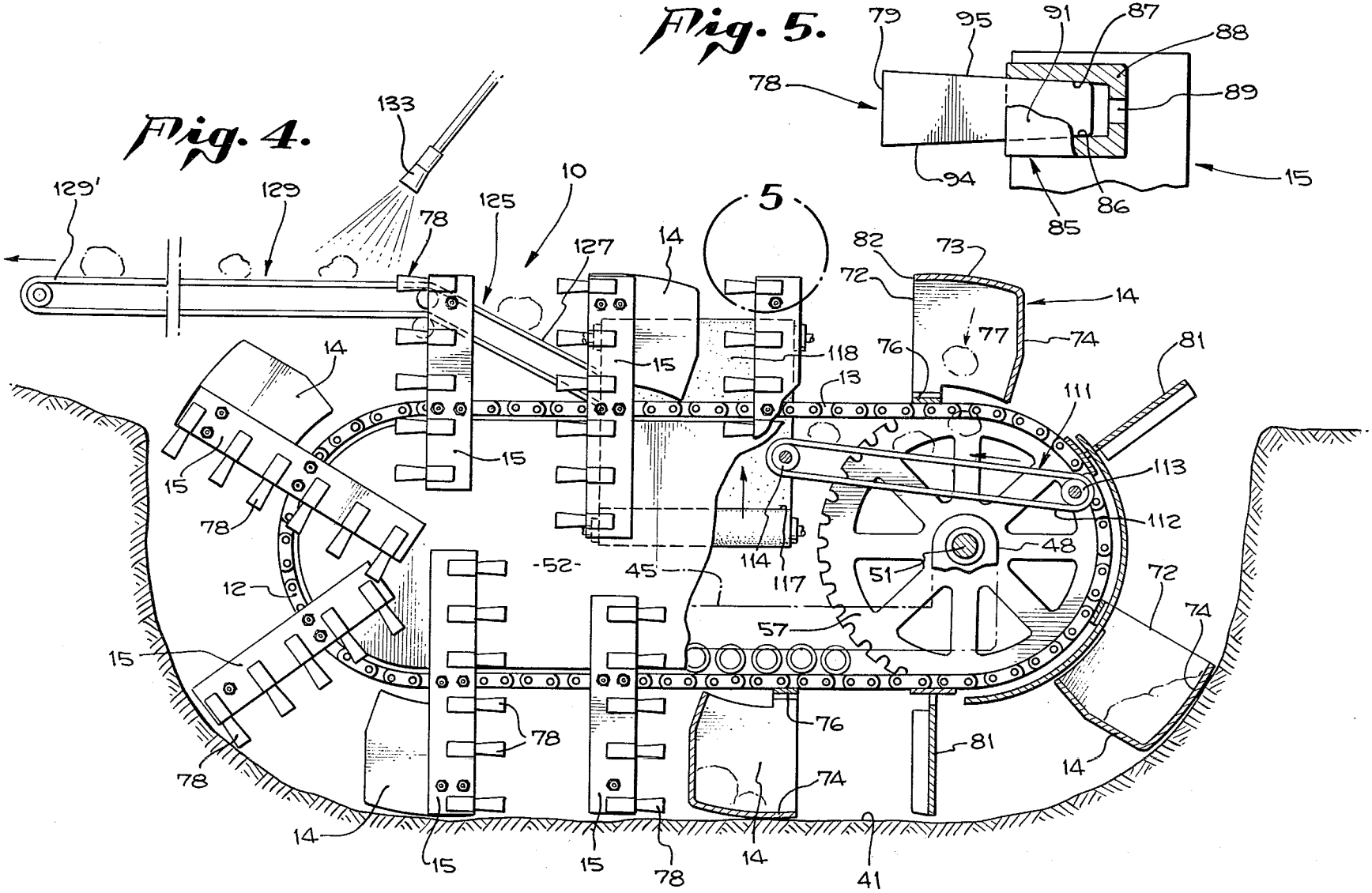
FIG. 4 is a cutting face elevation taken along line 4—4 of FIG. 3.
FIG. 5 is a fragmentary elevation, partly in section, of a removable cutting blade.

FIG. 5 illustrates one means of attachment for the blades 78 to the cutter arms 15. A plurality of sockets like the socket 85 of FIG. 5 each have converging side walls 86, 87 closed by end wall 88, which contains a vent 89. A web 91 closes the socket between side walls. The blades each have a cutting edge 79 and converging side walls 94, 95, which are converging at the degree of convergence of the socket side walls. The blades are therefore pressfitted into the sockets and removable by force applied to the butt end of a blade through vent 89 to replace broken or spent blades.

As is apparent from FIG. 4, the extent of the cutter arms and their blades 78 within the area circumscribed by the chain 12 affords a cutting or scraping action against the face 39 of the bank or mine head from the center line (transverse) of the digger conveyor outwardly to the extreme radial path of the outermost blade edge. As the digger conveyor advances under the urging of the prime mover, the separate power units drive the buckets and cutter arms in a path across the path of advance. The operator controls both the advance rate and the conveyor speed in accordance with the terrain. For instance, in tunnel work the advance is not as great as in open pit work, since the buckets are working throughout their traverse of the sprocket wheels in the former mode.

Figure 6:
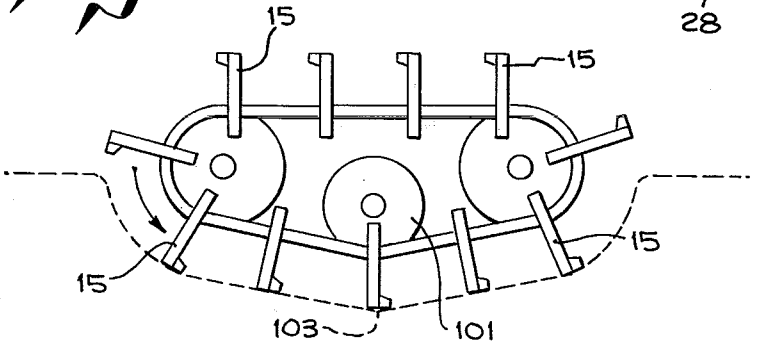
FIG. 6 is a schematic cutting face elevation of an alternate embodiment of the invention employing three conveyor sprocket pairs.
Figure 2:
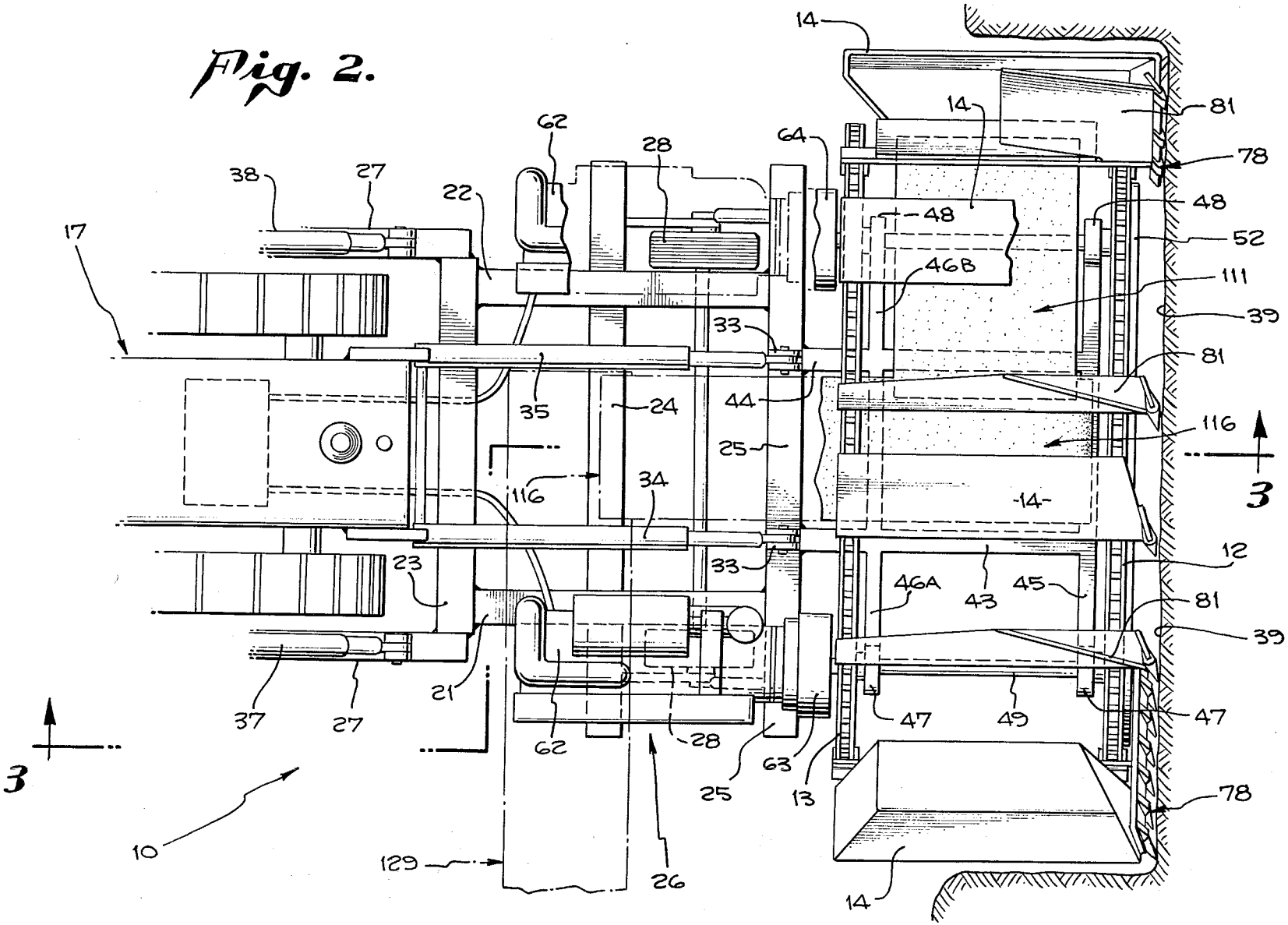
FIG. 2 is a schematic plan view, partly broken away, of the embodiment of FIG. 1.
Figure 3:
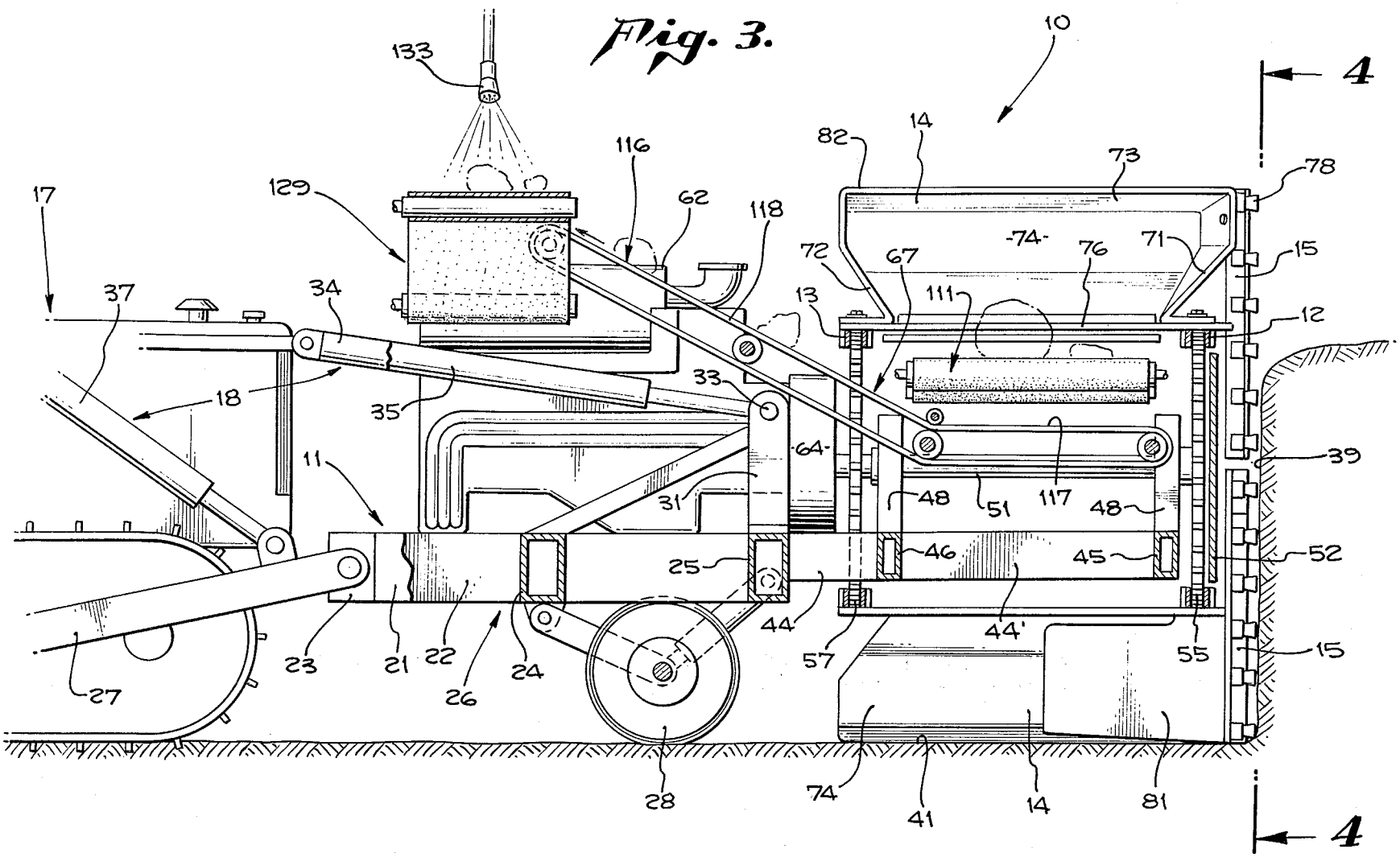
FIG. 3 is a longitudinal section elevation taken along line 3—3 of FIG. 2.

In FIG. 6 an alternate embodiment of the invention employing a secondary wheel pair is shown, since in some instances a sloping cut in either floor or roof may be desired. Thus, an intermediate sprocket wheel 101 may be secured between the two sprockets in a plane, such as the sprocket pairs of chains 12 and 13 of the previously described embodiments, to alter the path of the digger conveyor between the outer sprockets. In the illustrated embodiment the intermediate sprocket wheel 101 is placed to depress the travel of the digger conveyor so that a shallow floor trough with an apex at 103 is defined. Since both buckets and cutting arms are secured to the chain 12, the cutting configuration of both are alike, and the scoop buckets are not burdened excessively with deforming the floor line independently of the cutting arms.

It is obvious that should the intermediate sprocket wheel of the embodiment of FIG. 6 be displaced upwardly to the same degree as it is displaced downwardly in that Figure, a roof line having an arch configuration can be excavated with the earthmover of the invention. No changes in elements other than the intermediate sprocket wheels for the two conveyor chains need be made, including the belt conveyors for removed material or cuttings.

The Belt Conveyor System

While several different removal systems may be used with the excavator of the invention, the illustrated one is preferable, in that it is conventional in its components if not its combination with the other elements of the invention. The initial element 111 is seen in FIG. 4 in cross-section, intermediate the chains 12 and 13 where the scoop buckets invert to dumping attitude, as shown by bucket 14A. The element 111 comprises an endless belt 112 driven over spaced rollers 113, 114 of which roller 114 is the drive roller. Shield 52 is broken away in FIG. 4 to better show the belt and the sprocket wheel.

Second belt conveyor element 116 is evenly spaced between the transverse ends of the digger conveyor, and has a receiver section 117 and a ramp section 118. The configuration of the belt element is determined by rollers 119, 120, 121 and drive roller 122, with auxiliary idler roller 123 acting as a keeper against roller 120. Element 116 discharges onto a transverse belt conveyor element 125 comprised of receiver section 126 (FIG. 1), ramp section 127 and extended delivery section 129. Rollers similar to those of the second belt element achieve the configuration and powering of the transverse element 125.

While the extended section 129 of the belt conveyor may be limited to fit within the projected envelope of the digger conveyor for adaptation to tunnel and mining work, a cooperative tertiary belt conveyor system fed from the transverse element may deliver cut material to any site, for land reconstruction, strip mining rehabilitation, or road fill needs. For this reason the preferred embodiment of the invention affords water spray means for applying liquid to the cut material as it traverses the belt conveyor system. Therefore, a tank (not shown) at the prime mover has a supply line 131 with a valve 132 between the tank and the nozzle 133. To minimize load on the cuttings conveyor, the nozzle is shown near the discharge point from the transverse element. However, if the dust of working is a health or visibility handicap, the nozzle may be positioned to deliver liquid to the cut material as it emerges from the scoop buckets, at the expense of added power consumption by the excavator.

Added water has the advantages of easing handling (apart from weight), aiding compaction, and, in some cases, may result in self leveling fill sites. In addition, water may be conserved by more efficient application to only the cutting to be compacted, as opposed to broadcast wetting at the compaction site.

Modifications and changes other than those shown and described above will occur to those skilled in the art of the invention. Therefore, I desire that the invention be measured by the appended claims rather than by the illustrative description and drawing set forth herein.

I claim:

1. An excavator for use with a vehicle and comprising a frame, means for securing the frame to the vehicle, means for supporting the frame, a first conveyor wheel pair mounted to the frame to rotate in a plane perpendicular to the line of advance of the vehicle, a second conveyor wheel pair spaced from the first pair and mounted to the frame in a plane perpendicular to the line of advance of the vehicle; a digger conveyor on the wheel pairs, cutting means fixed to the digger conveyor, a portion of said cutting means extending outwardly from the conveyor in the direction of forward travel of the vehicle; drive means on the frame for rotating the conveyor wheel pairs, movable belts adapted to receive cuttings from the digger conveyor and delivering such cuttings outboard of the excavator, and control means for the wheel pairs drive means extending between the vehicle and the excavator frame.

2. An excavator in accordance with claim 1 wherein the cutting means comprises scoop buckets extending transversely to the path of advance of the digger conveyor, and a plurality of cutter blades co-extensive with the radial projection of the scoop buckets.

3. An excavator in accordance with claim 2 wherein the cutter blades extend radially into the area defined by the conveyor about the wheel pairs.

4. An excavator in accordance with claim 1 further comprising an added conveyor wheel in each plane perpendicular to the path of advance of the prime over such that the planar path of the digger conveyor is defined by three nonparallel legs.

5. An excavator in accordance with claim 1 wherein the frame is removable from the prime mover.

6. An excavator in accordance with claim 1 wherein the prime mover and the frame are integral.

7. An excavator in accordance with claim 1 further comprising removable cutting teeth and fixed baffle plates on at least a portion of the cutting blades.

8. An excavator in accordance with claim 1 further comprising water spray means adapted to emit water toward the movable belts.

9. An excavator in accordance with claim 1 further comprising drive means on the frame, coupler means between the drive means and each conveyor wheel of a pair, a dirt shield at the cutting face, cutter blades at each scoop bucket and between adjacent scoop buckets, baffles fixed to each cutter blade between adjacent scoop buckets, and auxiliary support wheels for the frame between the prime mover and the digger conveyor.

* * * * *